United States Patent [19]

Dalbo et al.

[11] 4,264,011

[45] Apr. 28, 1981

[54] PORTABLE THREAD STORAGE APPARATUS

[75] Inventors: Lorraine E. Dalbo, Atlanta; Relda W. Eaton, Decatur, both of Ga.

[73] Assignee: Dal-Craft, Inc., Atlanta, Ga.

[21] Appl. No.: 78,158

[22] Filed: Sep. 24, 1979

Related U.S. Application Data

[63] Continuation-in-part of Ser. No. 32,451, Jul. 19, 1979, abandoned.

[51] Int. Cl.[3] ..... B65D 85/00; A47M 31/00

[52] U.S. Cl. ..... 206/574; 206/388; 206/459; 223/107

[58] Field of Search ..... 206/574, 388, 380, 227, 206/472, 459; 229/45; 223/107

[56] References Cited

U.S. PATENT DOCUMENTS

| | | | |
|---|---|---|---|
| 1,719,648 | 7/1929 | Browne | 206/472 |
| 2,545,611 | 3/1951 | Flannery | 206/380 |
| 2,646,196 | 7/1953 | York | 206/388 |

*Primary Examiner*—William T. Dixson, Jr.
*Attorney, Agent, or Firm*—James B. Middleton

[57] ABSTRACT

A thread storage apparatus is disclosed. The apparatus includes a plurality of storage cards having holes along one edge for receiving loops of thread, and holes along the opposite edge for holding the cards in an expandable binder. The loops of yarn extend into a pocket to secure the free ends of the loops of thread, and the pocket is foldable over the back panel of the binder. Top and bottom end flaps may be provided to close the ends of the binder, and a front panel is provided as a front closure. An index card may be provided to assist in locating threads, and a use card may be provided for separating thread required for one project.

11 Claims, 17 Drawing Figures

PORTABLE THREAD STORAGE APPARATUS

CROSS REFERENCE TO RELATED APPLICATION

This application is a continuation-in-part of the copending application by the same inventors, titled "Thread Organizer Kit", filed July 19, 1979, and having Ser. No. 32,451 now abandoned.

FIELD OF THE INVENTION

This invention relates generally to containers for thread and the like, and is more specifically concerned with a portable storage apparatus for a plurality of different threads, the threads being easily locatable and retrievable.

BACKGROUND OF THE INVENTION

There are numerous forms of sewing, or needlework, wherein a person is required to have a relatively large number of different threads or yarns, the various threads having different colors, textures or the like. Generally, in the various forms of needlework, the different kinds of thread are utilized for different portions of a given pattern, and it is important that the person be able to select any desired kind of yarn when needed. Sometimes the various colors of yarn or thread used are very similar in shade, so it is desirable to have some means for readily determining exactly which thread is being selected, and to be able to select quickly and easily any specified thread.

Most commonly, people doing needlework simply retain the original wrapper for their threads, and place the entire thread as purchased in a bag or the like; then, when a particular kind of thread is needed one must search through the bag, checking the label on each piece of thread, until the appropriate type of thread is found. There have been some efforts to organize these threads, but such efforts have generally taken the form simply of a card to receive a length of thread. One prior art apparatus includes a card which receives two or four different yarns, and a plurality of the cards can be placed in a conventional notebook or the like. This device would be extremely bulky, and would be almost totally impracticable for an even slightly complex embroidery design because of the need to store such a large variety of different colors of thread. Another attempt to solve the above mentioned problem is the use of a large card, a single card simply being made large enough to handle a rather great variety of kinds of thread. While this device will serve to organize the threads, it is unhandy to transport and requires a rather large storage space when not in use. Additionally, such a flat card provides no means for protecting the threads from dust and dirt when the threads are not in use.

SUMMARY OF THE INVENTION

The present invention overcomes the above mentioned and other difficulties with the prior art thread storage devices by providing a plurality of storage cards for receiving a plurality of lengths of yarn along one edge of each of the storage cards. The storage cards are then receivable in a binder, the binder having a foldable tab for receiving the extending ends of the lengths of yarn, and means for holding the extending ends to the tab. The tab is then foldable to be within the confines of the binder. Binding means are provided for holding the plurality of storage cards within the binder.

BRIEF DESCRIPTION OF THE DRAWINGS

These and other features and advantages of the present invention will become apparent from consideration of the following specification when taken in conjunction with the accompanying drawings in which.

DESCRIPTION OF THE PREFERRED EMBODIMENT

Figure 1:
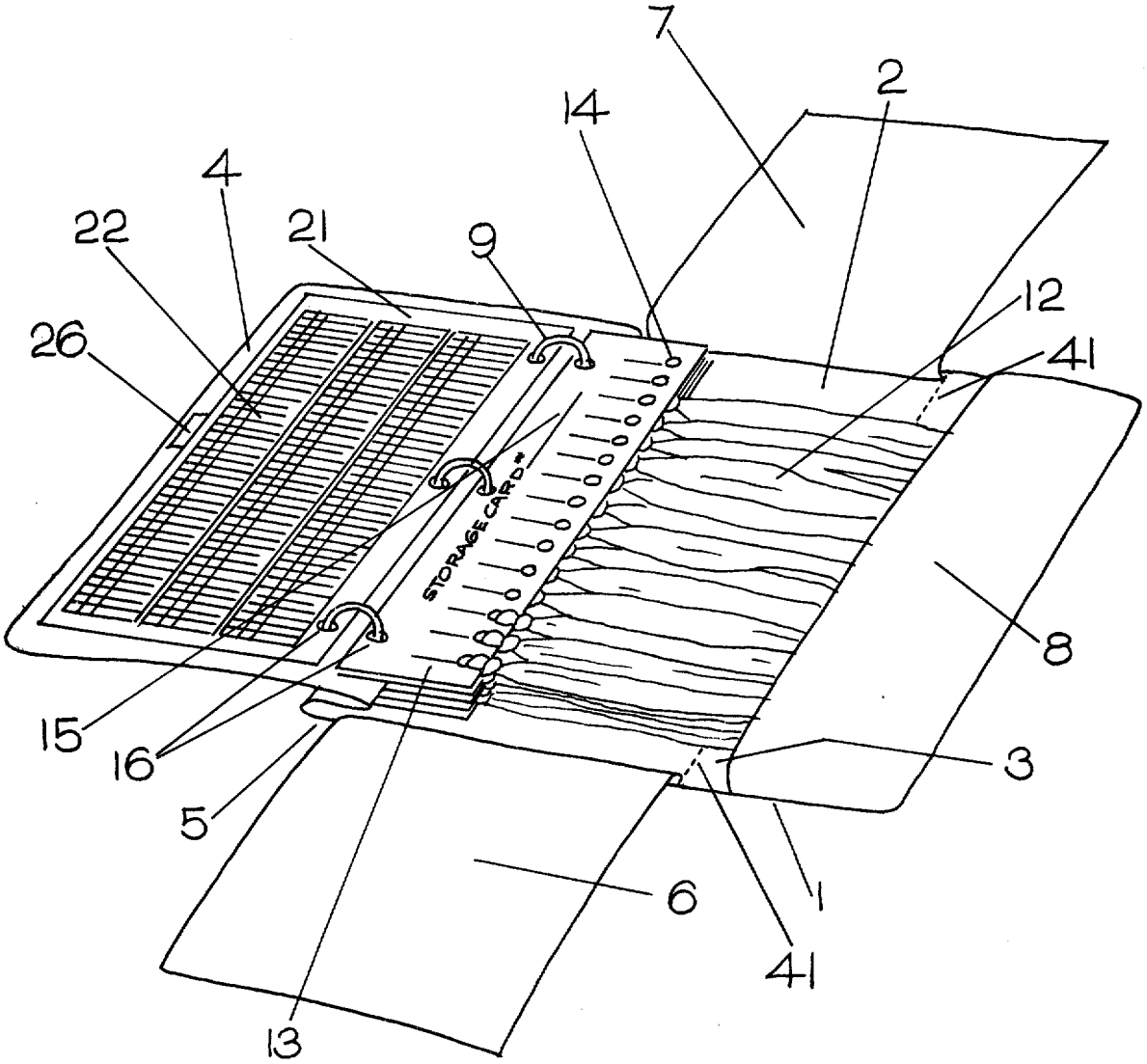
FIG. 1 is a perspective view of a thread storage apparatus made in accordance with the present invention, the device being shown open, but with the ends of the thread secured to the tab.

Referring now more particularly to the drawings, and to that embodiment of the invention here presented by way of illustration, it will be seen that the thread storage apparatus comprises a plurality of storage cards 11 which define a plurality of holes 14 along one edge thereof. Each of the holes 14 is appropriately sized to allow a loop of thread 12 to be tied through the hole 14, and sufficient space is allowed between each of the holes 14 so that a person can tie and untie various loops of thread 12 without interfering with adjacent loops of thread.

Along the opposite edge of the storage card 11, means for binding the storage card 11 into a binder is provided. While those skilled in the art will realize that numerous forms of binding may be utilized, the means here shown includes a plurality of binder rings 9 which are receivable through appropriate holes 16 in the storage card 11. It will be understood that the binder rings 9 are of conventional design and are openable to allow the binder rings to be placed through the various holes, after which the binder rings can be snapped shut and will remain securely fastened until intentionally reopened.

It will therefore be seen that, the storage card 11 can be bound along one edge thereof and the plurality of holes 14 can be extended along a different edge of the storage card 11. From the holes 14, the various loops of thread will be extended generally perpendicularly to the edge of the storage card 11 as is shown in FIG. 1 of the drawing.

While the binding means 16 is here shown as provided in the edge opposite and parallel to the edge including the holes 14, it will be readily understood by those skilled in the art that an adjacent edge of the storage card 11 could be the edge to receive the binding, only minor modifications being made in the binder itself to accommodate such an arrangement.

The storage card 11 includes a plurality of lines 13, one line 13 being adjacent to each of the holes 14. It is contemplated that some form of description of the threads 12 that are attached to the particular hole 14 will be entered on the adjacent line 13. This indication may be simply a number, an abbreviation for a color, or other information that would be meaningful to the user of the threads. Also, there is a line 15 for appropriate designation of the storage card 11 so that a plurality of storage cards 11 can be uniquely identified. This will be discussed in more detail hereinafter.

The storage apparatus 1 comprises a back panel 2 having a right hand tab 3 extending therefrom. While it is contemplated that the right hand tab 3 may be formed as a continuation of the back panel material, it is also well within the scope of the present invention for the right hand tab 3 to be made of a separate piece of material and hinged or otherwise fixed to the back panel 2.

At this point it should be understood that many forms of thread or yarn are conventionally sold in standard packages. For example, embroidery thread is sold in various standard lengths, and the various standard lengths can all be formed into a loop of a given dimension from one end to the other. With this in mind, a storage apparatus would be designed to receive various loops, and would be appropriately dimensioned to handle such loops. While it will be realized that all dimensions can be varied to suit the particular demands, for convenience of illustration a conveniently sized loop of embroidery thread will be used by way of example.

Figure 3A:
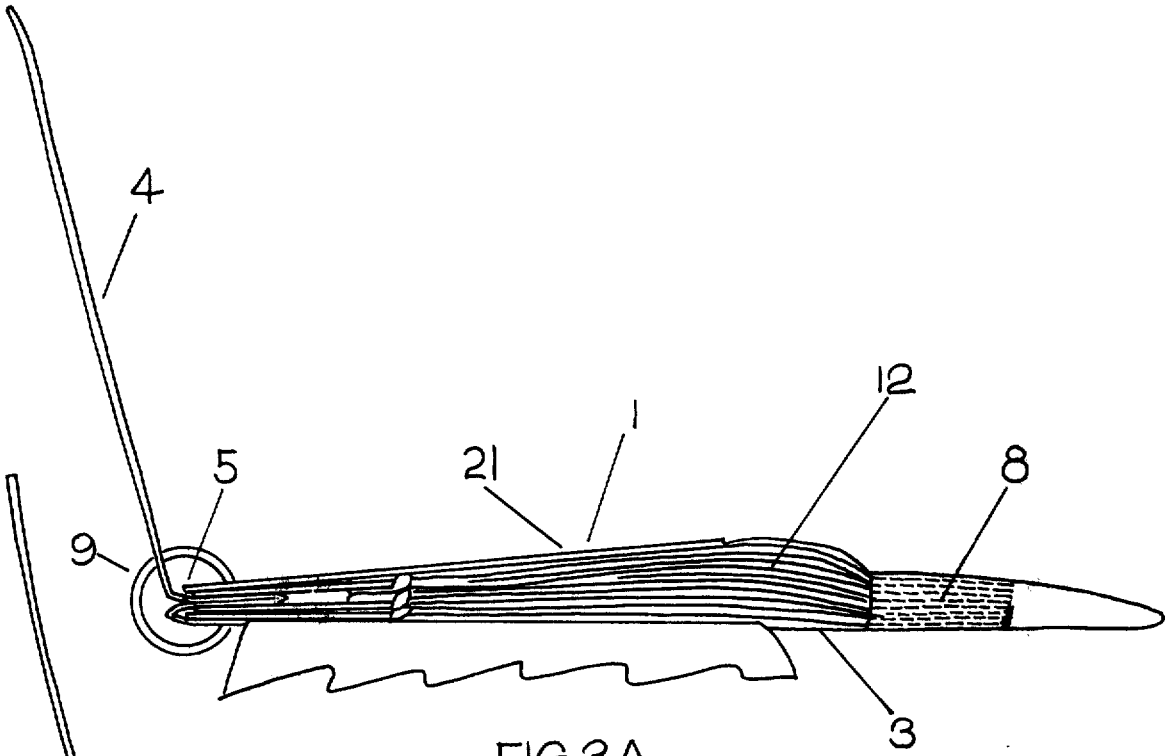
FIGS. 3A–3B are bottom plan views of the device shown in FIG. 1 showing the folding of the tab.
Figure 3B:
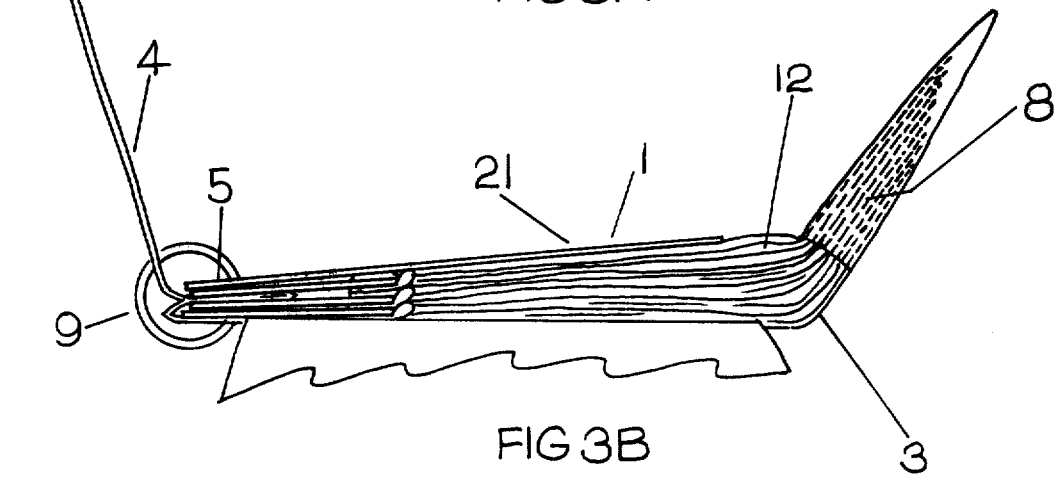
Figure 4A:
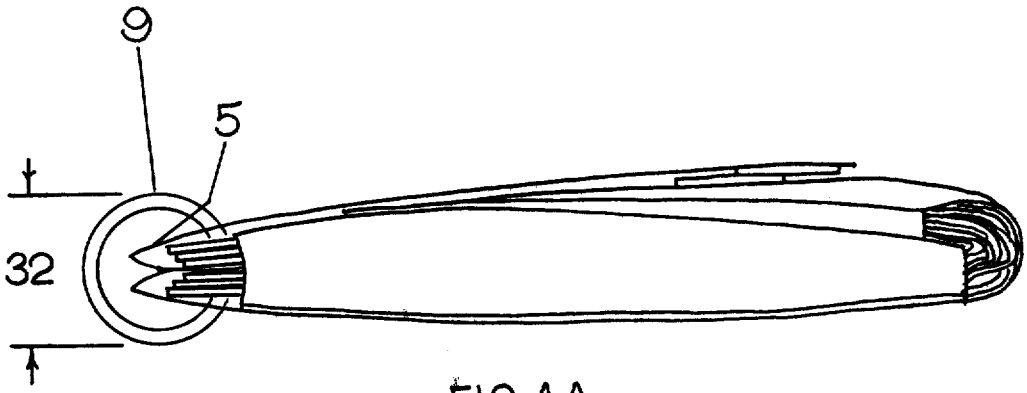
FIG. 4A is a bottom plan view of the completely folded apparatus as shown in FIG. 1.
Figure 4B:
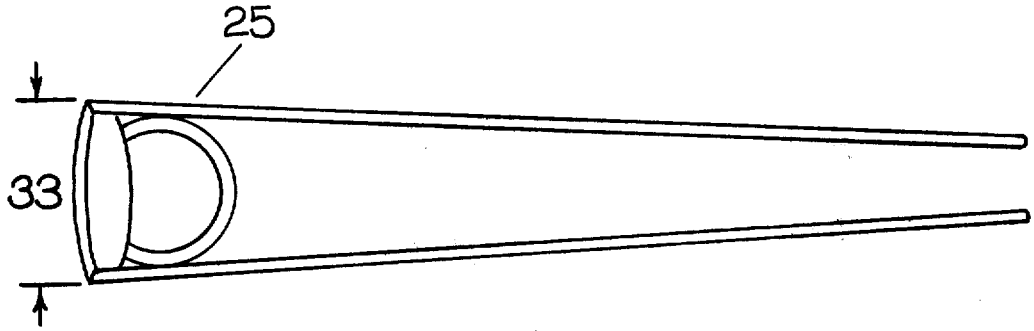
FIG. 4B is a bottom plan view of a prior art ring-binder, here shown for comparison.

Returning now to FIG. 1 of the drawings, and with reference to FIG. 3A of the drawings, it will be seen that the storage cards 11 have the loops of thread 12 appropriately knotted through the holes 14. The loops of thread 12 are then extended generally perpendicularly to the edge of the storage card 11 and the storage card 11 lies over the back panel 2 with the loops of thread 12 extending across the bank panel and onto the right hand tab 3. It will then be seen that the right hand tab 3 has a holding device 8 which overlies the ends of the loops of thread 12 to hold the loops of thread 12 against the tab 3. Thus, even though there is a very large number of loops of thread 12, the various loops 12 are held quite neatly so that one can always retrieve a single loop 12 as desired.

The storage device 1 is also provided with a front panel 4 which is adapted to provide a front closure for the device, the front panel 4 also including holes 16 to receive the binder rings 9 so that the front panel 4 can be folded over the storage cards and the loops of yarn 12.

In the embodiment here presented, the storage apparatus 1 further includes a top end flap 7 and a bottom end flap 6. The flaps 7 and 6 are attached respectively to the upper and lower edges of the back panel 2, and are adapted to be folded over the threads and the storage cards for appropriate end closure.

It is contemplated as shown in FIG. 1 of the drawings that a plurality of these storage cards 11 would be received within any given storage device 1, and each storage card 11 includes perhaps 12 to 15 different loops of thread 12. In order to be able to retrieve any given color, type or other particular yarn or thread 12, an index card 21 is provided, the index card 21 having a printed form 22 on which the individual threads 12 can be listed. As shown, it will be understood that the printed form 22 on index card 21 can include appropriate spaces for the full identification of the particular thread, such as by color, stock number or the like, and can include other columns to identify the particular storage card and other location for that particular thread. It will therefore be realized that the user can scan the index card 21 and locate the desired thread, then turn immediately to the particular storage card and find the exact thread required.

Figure 2A:
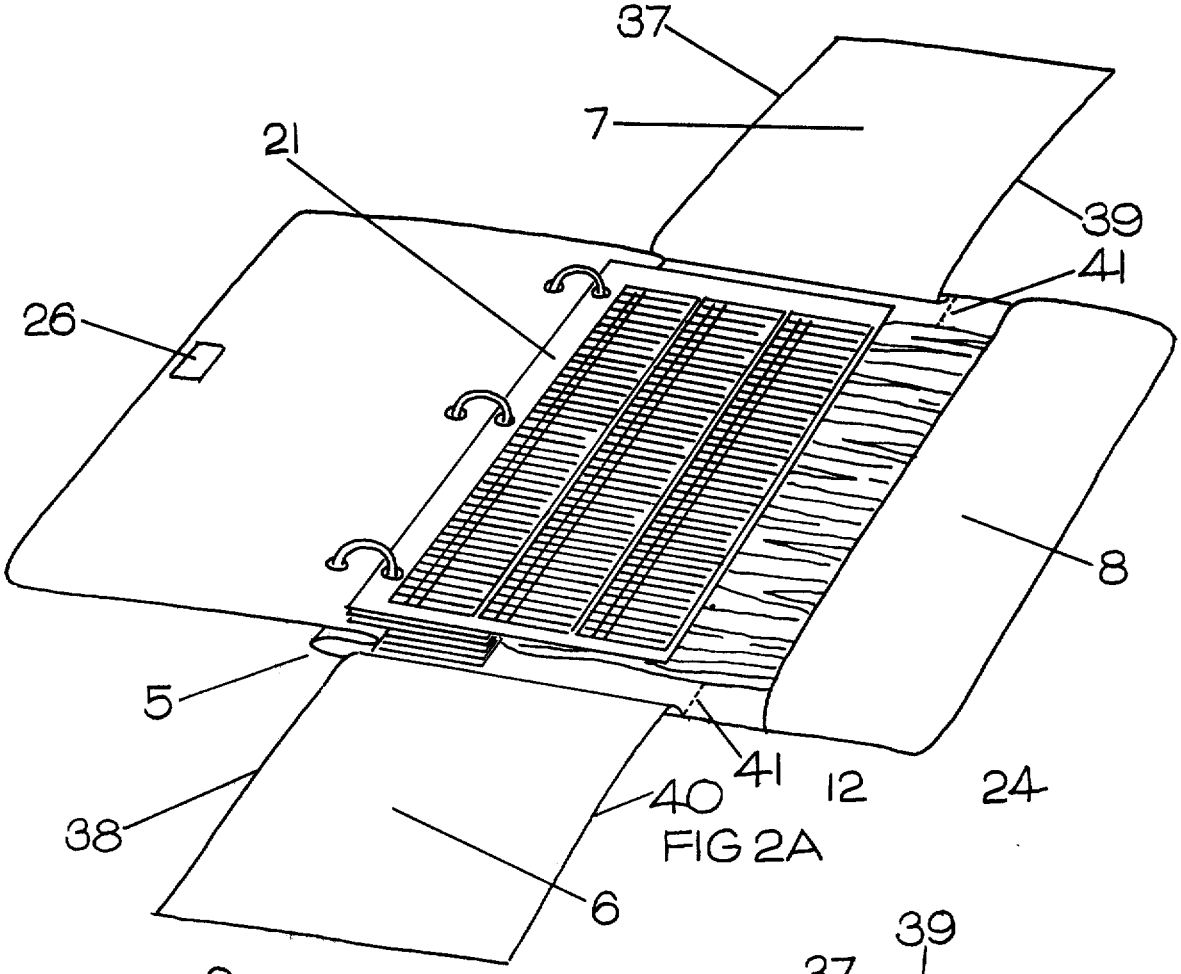
FIGS. 2A–2D are perspective views of the device shown in FIG. 1, and showing sequential steps in folding the device to enclose the threads.
Figure 2B:
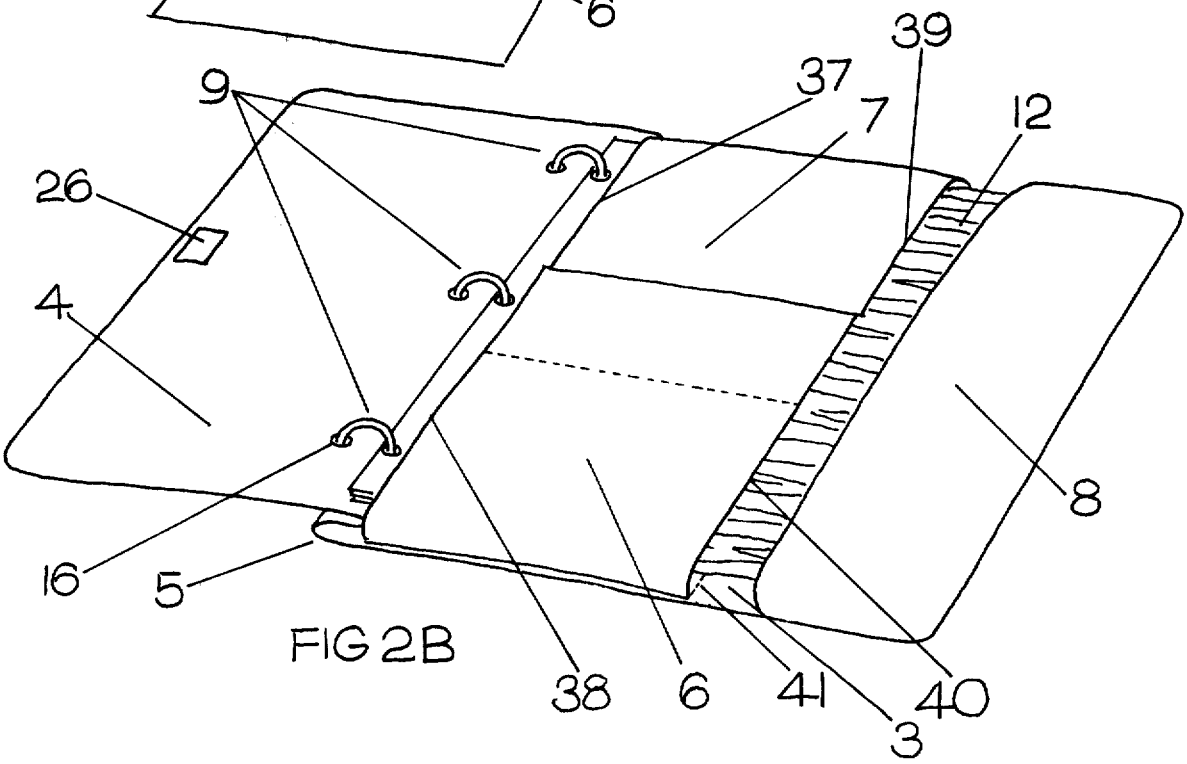

Attention is next directed to FIG. 2A of the drawings which shows the storage device 1 prepared for closing. It will be seen that the index card 21 is folded over to be placed on top of the individual storage card 11, and the storage card 21 extends somewhat over the threads 12, but the storage card 21 falls short of the line 41 where the back panel 2 and the right hand tab 3 are joined. Next, looking at FIG. 2B, the top and bottom flaps 7 and 6 respectively are folded over the index card 21. It will be seen, in FIG. 2B, that the edges 37 and 38 of the flaps 7 and 6 respectively are located to be inwardly of the binder rings 9 so that the top and bottom flaps 7 and 6 do not interfere with the binding for the storage device 1.

Figure 2C:
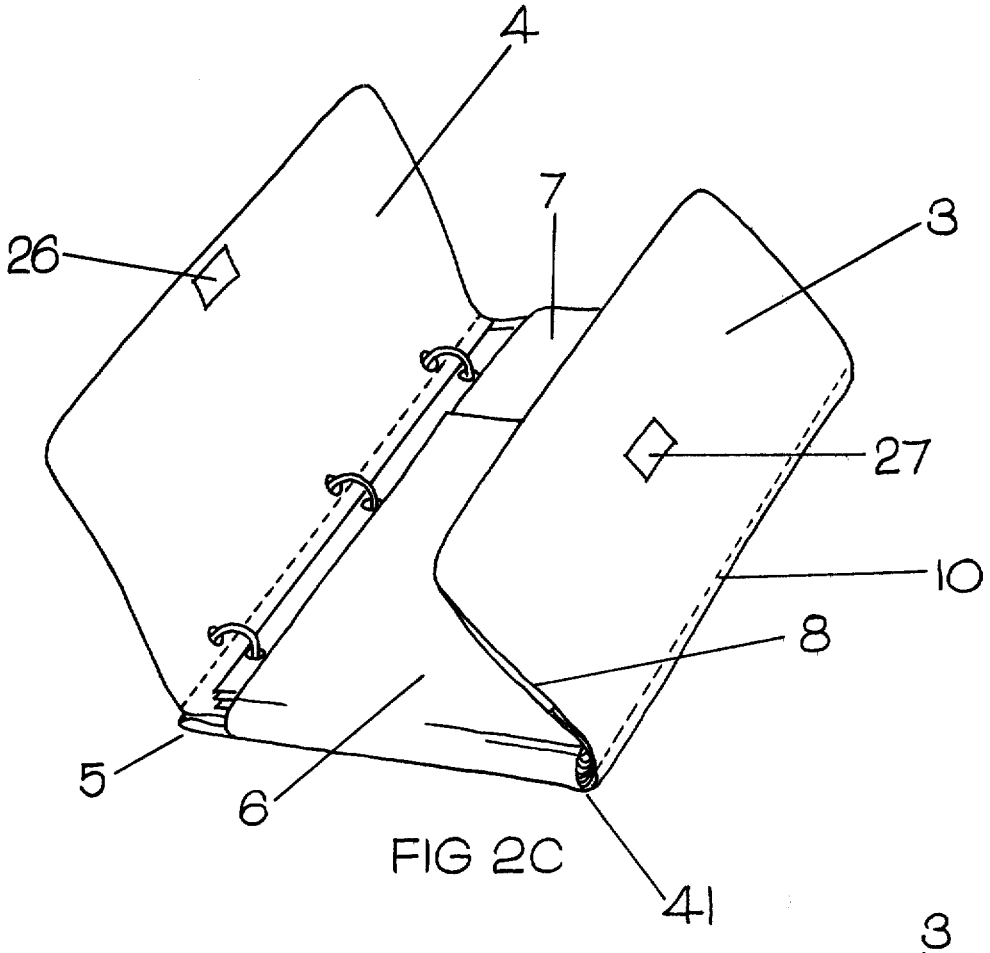

Next, the right hand tab 3 will be folded over as is shown in FIG. 2C. It will be understood that the ends of the loops of thread 12 are held within the pocket formed by the tab 3 and the holding device 8 so that the ends of the threads will be held very neatly as the tab 3 is folded over. Also, if the index card 21 is used with the apparatus, the right hand edge of the card 21 may act as a folding guide as the tab 3 is folded.

It will also be seen in FIG. 2C of the drawings that there is a fastening means for the storage device 1. As is shown in FIG. 2C of the drawings, the fastening device preferably includes a hook and teazle fastening means with a first part 26 being fixed to the front panel 4 as shown at 26. The other fastener part is then fixed to the back side of the right hand tab 3 as indicated at 27.

While those skilled in the art will realize that numerous forms of fastening means may be used, the hook and teazle fastener is desirable in that almost any contact between the relatively large fastener parts 26 and 27 will be sufficient to hold the flaps in closed condition.

Figure 2D:
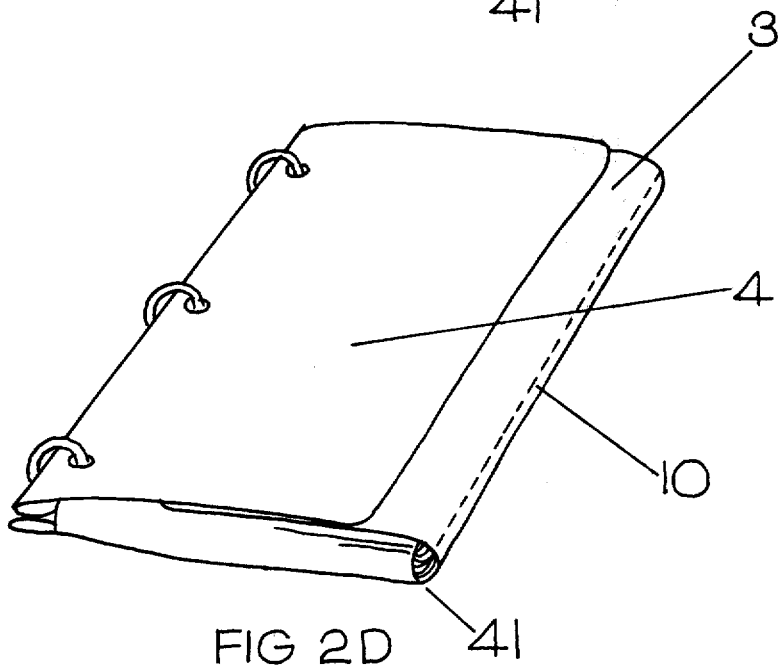

Thus, looking at FIGS. 2C and 2D, it will be seen that the right hand tab 3 is folded over and the front flap 4 is folded to overlie the right hand tab 3. Because of this, the fastener part 26 will engage the fastener part 27 to hold the device closed. The device as shown in FIG. 2D is entirely closed, and it will be seen that the storage device is a very neat package, with the threads within the package totally protected.

Figure 5A:
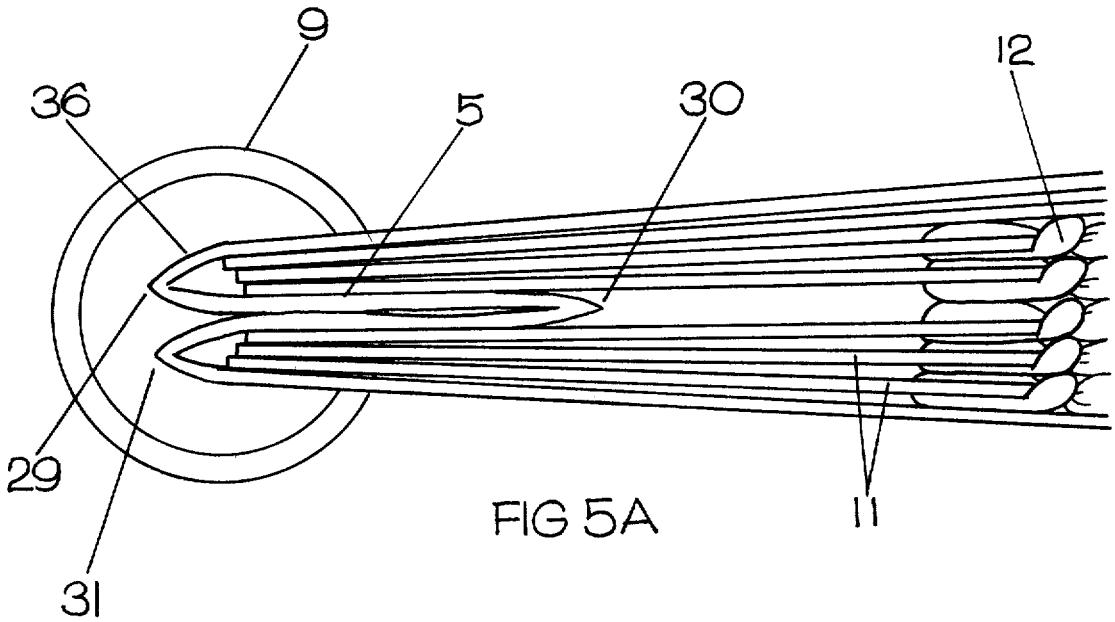
FIGS. 5A–5B are enlarged, partial bottom plan views showing the attachment of the storage cards and the binder to the binder rings.
Figure 5B:
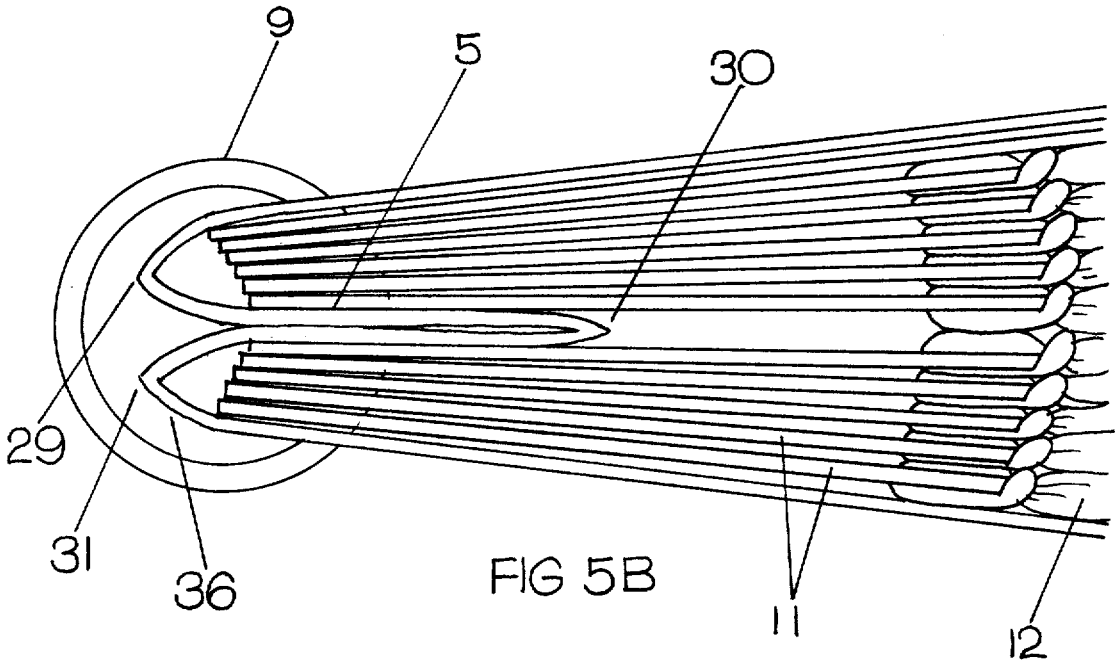
Figure 6A:
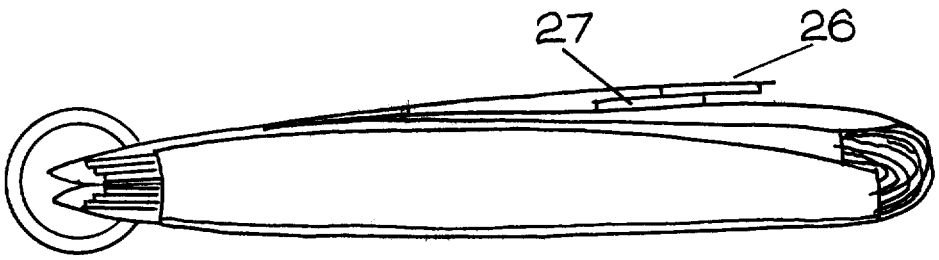
FIGS. 6A–6B are full bottom plan views similar to FIGS. 5A–5B.
Figure 6B:
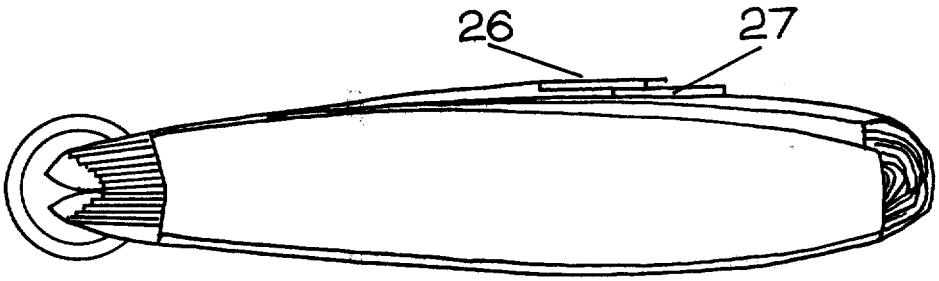
Figure 7:
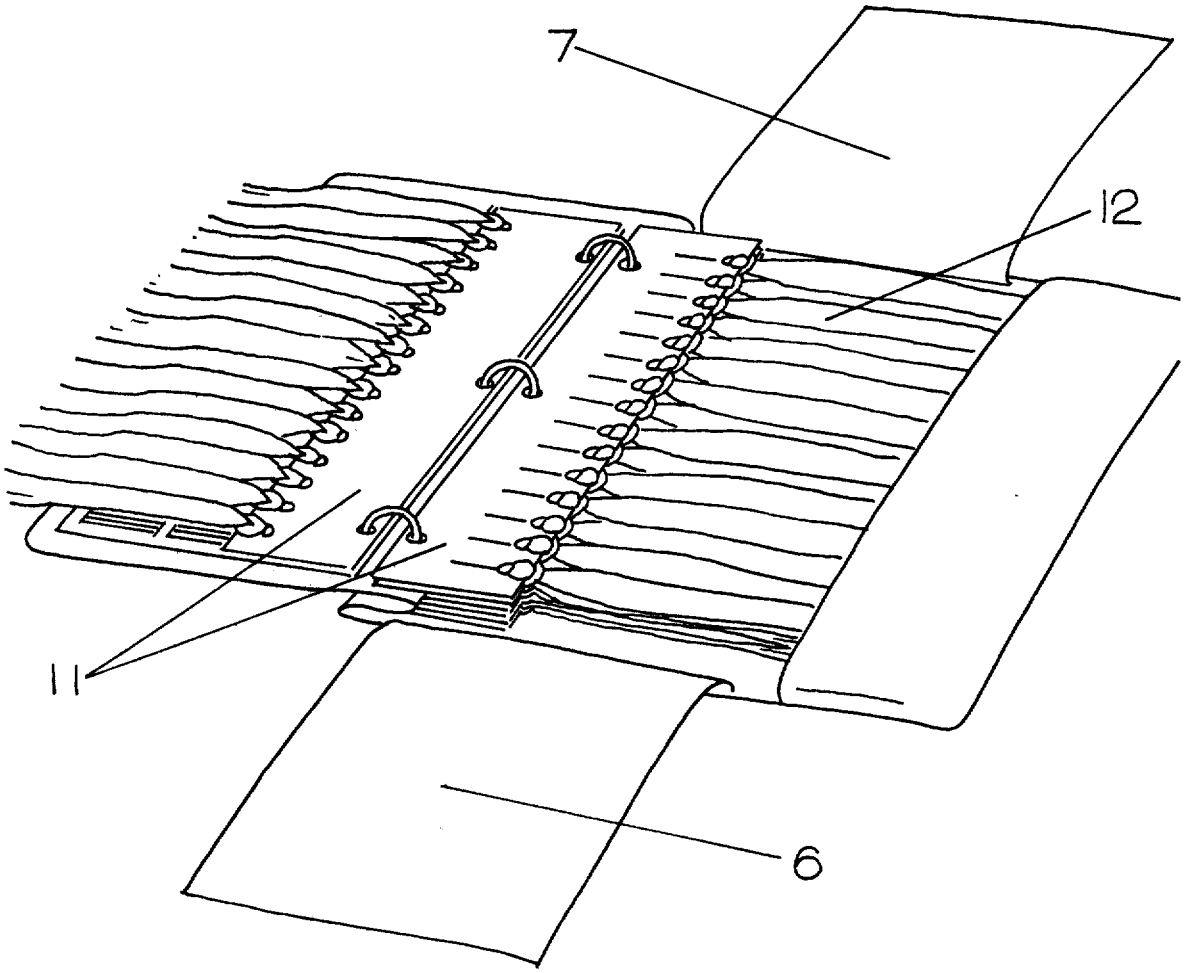
FIG. 7 is a perspective view similar to FIG. 1 but showing one of the storage cards on the left to expose the next group of threads.
Figure 8A:
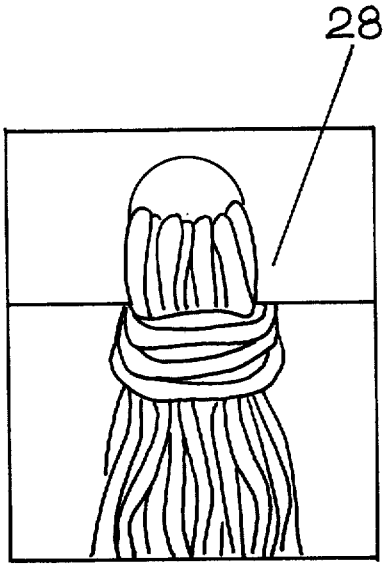
FIGS. 8A–8B are enlarged figures showing the attachment of the length of thread to a storage card; and, FIG. 9 is a perspective view of a use card which may be utilized in conjunction with the present invention.
Figure 8B:
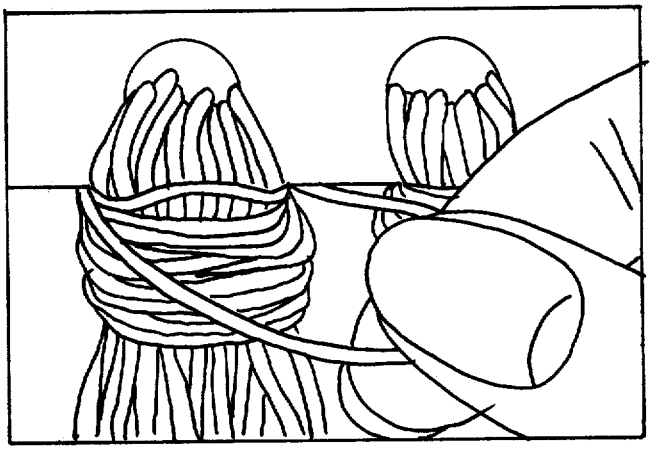

With attention directed to FIGS. 5A and 5B of the drawings, it will be seen that the construction of the particular binder is admirably suited to the present invention. The front panel 4 and back panel 2 are here shown as being connected together by a center divider 5. With this arrangement, the entire binder may be formed of a single piece of material appropriately folded at 29, and return-folded at 30 to provide the center divider 5; then, the material is folded again at 31 to provide the back panel 2. The front panel 4, the central divider 5 and the back panel 2 are all punched appropriately with holes 16 to receive the binder rings 9. A plurality of these storage cards 11 can be placed between the front panel 4 and the central divider 5, and a second plurality of the storage cards 11 can be placed between the central divider 5 and the back panel 2. With this arrangement, the storage cards 11 are conveniently divided into 2 discrete groups which may be very useful in many applications. Alternatively, of course, the central divider 5 may be sufficiently short that the central divider 5 would not be punched, and would not have the binder rings 9 passing therethrough. In that case, the central divider 5 would simply provide for expansion, but with a covered spine. As a further alternative, the central divider 5 may be completely omitted and the front panel 4 and the back panel 2 may be separate pieces of material.

Figure 9:
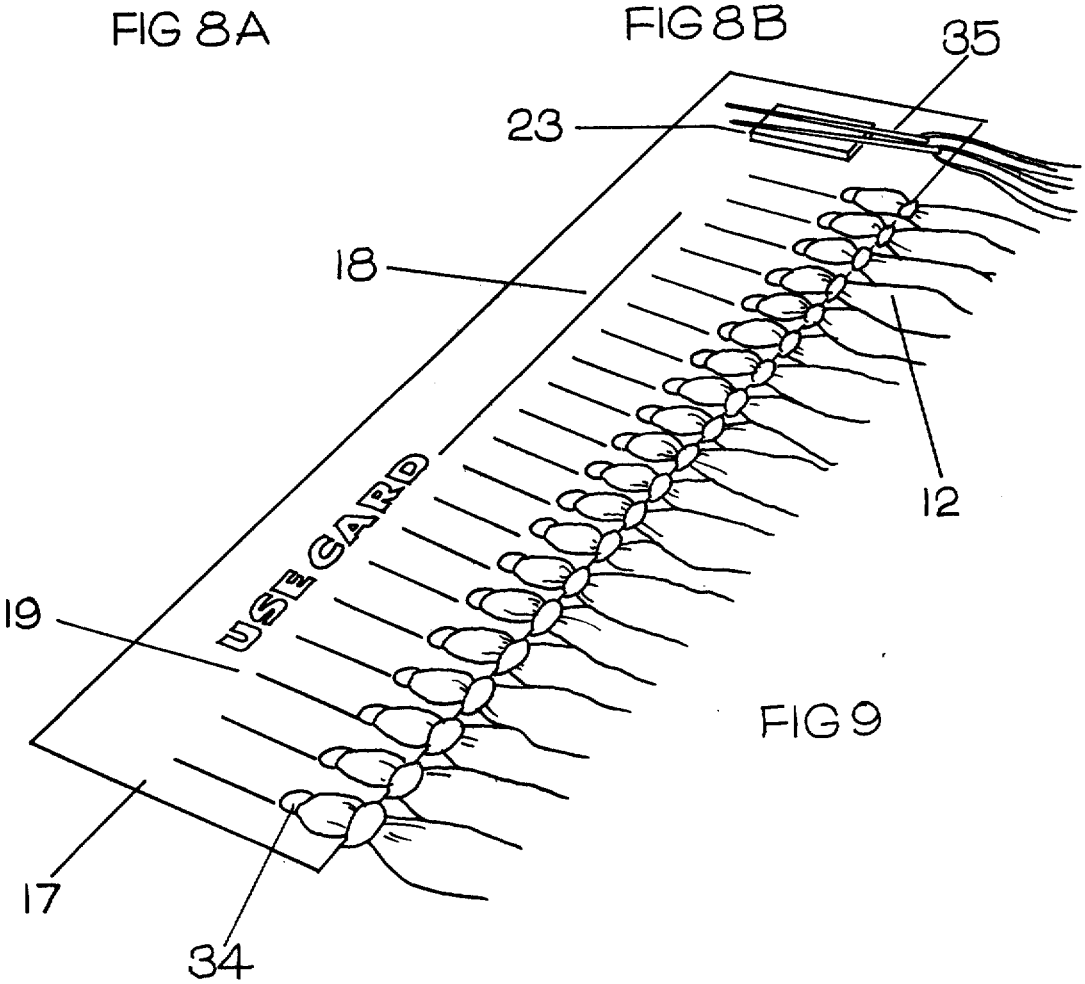

As an added feature in using the storage device of the present invention, a use card 17 may be provided as is shown in FIG. 9 of the drawings. The use card 17 is similar to one of the storage cards 11, but it is not necessary that the use card 17 be provided with means for binding the card into a binder or the like.

The use card 17 is provided with a plurality of holes 34 for receiving loops of thread 12 similar to the storage cards 11. The use card 17 further has a line 19 adjacent to each hole 34 for an appropriate indication of the particular thread 12 in that hole, and is provided with a line 18 which may be used as the title of the project. A needle holding means 23 is provided for holding needles 35, the means 23 being here shown as comprising a magnet.

It will therefore be understood by those skilled in the art that, when a person is preparing a particular sewing project that requires a plurality of different threads, a use card 17 may be selected, and the title of the project may be entered on line 18. Next, the various threads to be used in the project can be entered on the various lines 19. After the appropriate thread designations are entered on the various lines 19, one can go to the storage device 1, refer to the index card 21 and locate the various threads 12. An appropriate supply of each thread can be removed from the storage apparatus 1 and placed into the appropriate hole 34 of the use card 17. When all required threads are placed in the holes 34 of the use card 17, the project can be started. When the project is interrupted, a needle with an appropriate piece of thread can be placed on the magnet 23 or other needle holding means to be ready for use when the project is resumed.

It will therefore be seen that a use card 17 can be set up for one project, and that card can be retained with the project until the project is completed. Any remaining thread could then be returned to the storage device 1 by again matching thread numbers and utilizing the index card 21.

From the foregoing discussion, it will now be understood that the storage device 1 provides a very simple and convenient storage apparatus for storing a great variety of different kinds of thread or the like, and yet provides easy and convenient retrieval means for any desired type of thread. The index card 21 can be used to determine which storage card is to be used, then the storage cards 11 can be turned like pages of a book until the appropriate storage card is found. As one uses various threads, the storage cards can be turned back and forth with great ease as the user selects various threads. After the user has finished with the threads, at least temporarily, all the storage cards would be placed to overlie the back panel 2, then the ends of the loops of thread 12 would be placed under the holding means 8 so that all threads would be held neatly. The index card 21 can then be folded over the threads, the top and bottom flaps, right hand tab 3 would be folded over and the front flap 4 would be folded over to allow the fastener part 26 to engage the fastener part 27 on the right hand tab 3. The storage device is then completely closed and secure for easy transportation.

It will of course be understood by those skilled in the art that the particular embodiment of the invention here presented is by way of illustration only and is meant to be in no way restrictive; therefore, numerous changes and modifications may be made, and the full use of equivalents resorted to, without departing from the spirit or scope of the invention as defined by the appended claims.

We claim:

1. Thread storage apparatus wherein a plurality of different threads is stored for easy location and retrieval, each thread of said plurality of threads being formed into a loop of thread having a length for providing a plurality of loops of thread, said storage apparatus comprising a plurality of storage cards, each storage card of said plurality of storage cards including means for receiving a group of loops of threads of said plurality of loops of thread along a first edge of said storage card, first binding means on a second edge of said storage card, the arrangement being such that each loop of thread extends from said first edge of said storage card a distance generally equal to said length, a binder, said binder comprising a back panel, a tab carried by said back panel, second binding means carried by said back panel for cooperation with said first binding means to hold said storage cards in said binder, said tab being so located and dimensioned that at least some of said loops of thread extending from said first edge of said storage card will terminate on said tab, holding means on said tab for holding the ends of said loops of thread to said tab, a front panel for said binder, said front panel being selectively superposed over said back panel, and fastening means comprising a first fastener part carried by said front panel, and a second fastener part carried by said tab.

2. Thread storage apparatus as claimed in claim 1, said tab being selectively foldable over said back panel so that said binder will have a width substantially equal to the width of said back panel.

3. Thread storage apparatus as claimed in claim 2, said binder further including a top end flap carried by the upper edge of said back panel, and a bottom end flap carried by the lower edge of said back panel, said top end flap and said bottom end flap being foldable over said storage cards for closing the ends of said binder.

4. Thread storage apparatus as claimed in claim 2, said second edge of said storage card being opposite and parallel to said first edge of said storage card, said first binding means comprising a plurality of holes defined in said second edge of said storage card, said second binding means comprising a plurality of binder rings receivable through said plurality of holes.

5. Thread storage apparatus as claimed in claim 2, each storage card of said plurality of storage cards further including identification means adjacent to said means for receiving a group of threads, said means for receiving a group of threads comprising a plurality of holes defined in said storage card along said first edge of said storage card, said identification means including indicia adjacent to each hole of said plurality of holes.

6. Thread storage apparatus as claimed in claim 5, and further including an index card receivable within said binder, said index card including index means for recording said indicia from said storage card.

7. Thread storage apparatus as claimed in claim 4, said binder further including a central divider formed integrally with said front panel and said back panel, said binder rings being receivable through holes in said central divider, a first plurality of said storage cards being receivable between said back panel and said central divider, and a second plurality of said storage cards being receivable between said central divider and said front panel.

8. Thread storage apparatus as claimed in claim 6, said index card having a right hand edge, which provides a folding edge for said tab.

9. Thread storage apparatus as claimed in claim 8, said holding means, in conjunction with said tab, defining a pocket for receiving the extending end of said loops of thread.

10. Thread storage apparatus as claimed in claim 9, and further including a use card having a plurality of holes therein for receiving a selected plurality of threads from said plurality of lengths of threads, identification means adjacent to each of said holes for receiving indicia from said storage cards, and needle holding means for releasably holding at least one needle, said needle holding means being carried by one face of said use card.

11. Thread storage apparatus wherein a plurality of different threads is stored for easy location and retrieval, each thread of said plurality of threads being formed into a loop of thread having a length for providing a plurality of loops of thread, said storage apparatus comprising a plurality of storage cards, each storage card of said plurality of storage cards including means for receiving a group of loops of thread of said plurality of loops of thread along a first edge of said storage card, first binding means on a second edge of said storage card, the arrangement being such that each loop of thread extends from said first edge of said storage card a distance generally equal to said length, a binder, said binder comprising a back panel, a tab carried by said back panel, second binding means carried by said back panel for cooperation with said first binding means to hold said storage cards in said binder, said tab being so located and dimensioned as to receive the extending ends of said loops of thread extending from said first edge of said storage cards, said tab being selectively foldable along a line generally parallel to said first edge of said storage cards to overlie at least a portion of said back panel for reducing said binder to the width of said back panel, a front panel for said binder, said front panel being selectively superposed over at least a portion of said back panel, and fastening means comprising a first fastener part carried by said front panel, and a second fastener part carried by said tab.

* * * * *